US006926035B2

(12) United States Patent
Ozagir

(10) Patent No.: US 6,926,035 B2
(45) Date of Patent: Aug. 9, 2005

(54) WATER TAP

(75) Inventor: Ozcan Ozagir, Birstall (GB)

(73) Assignee: Astracast, plc (GB)

( * ) Notice: Subject to any disclaimer, the term of this patent is extended or adjusted under 35 U.S.C. 154(b) by 0 days.

(21) Appl. No.: 10/624,121

(22) Filed: Jul. 18, 2003

(65) Prior Publication Data

US 2005/0011562 A1 Jan. 20, 2005

(51) Int. Cl.[7] ..... E03C 1/04
(52) U.S. Cl. ..... 137/801
(58) Field of Search ..... 137/801

(56) References Cited

U.S. PATENT DOCUMENTS 6,029,699 A 2/2000 Granot

FOREIGN PATENT DOCUMENTS

| | | |
|---|---|---|
| DE | 19957081 | 5/2001 |
| EP | 1154083 | 4/2001 |
| EP | 1101874 | 5/2001 |
| GB | 2104625 | 3/1983 |
| WO | WO91/07614 | 5/1991 |

*Primary Examiner*—Gerald A. Michalsky
(74) *Attorney, Agent, or Firm*—Madson & Metcalf

(57) ABSTRACT

A water tap having a tap body, separate connections on the tap body for receiving supplies of hot water H, cold water C and further liquid F, a common discharge spout mounted on the tap body, and valves for controlling the supply of hot water H, cold water C and further liquid F from the tap body to the discharge spout, in which: the discharge spout is provided internally with two separate discharge passages which lead to a common discharge outlet; the tap body defines a route for hot water only which communicates with a first separate discharge passage in the discharge spout; the tap body also defines separate incoming routes for the cold water C and the further liquid F, and a common outgoing route for either the cold water C or further liquid F and such common outgoing route communicating with a second separate discharge passage.

5 Claims, 2 Drawing Sheets

WATER TAP

This invention relates to a water tap having a tap body, separate connections on the tap body for receiving supplies of hot water, cold water and further liquid e.g. filtered water, a common discharge spout mounted on the tap body, and valves for controlling the supply of hot water, cold water and further liquid from the tap body to the discharge spout.

BACKGROUND TO INVENTION

In a conventional tap for hot and cold water only it is well known to provide a common discharge spout, for discharging hot and/or cold water, and the spout may have two separate passages, each dedicated to one of the hot and cold water supplies, and which have discharge outlets located adjacent to, or close to each other, and so that a single jet of hot and/or cold water can be discharged. Alternatively, the spout may have a single passage, along which hot only, or cold only water may pass, upon opening of the hot or cold valves. In addition, the tap body may incorporate a premixing chamber, in which hot and cold water supplies may be mixed (upon opening of both of the hot and cold water valves), prior to the mixed supply passing along the single passage in the discharge spout to be discharged as a mixed jet of hot and cold water.

It is also known to provide a discharge spout with three separate dedicated passages, corresponding to supply of hot, cold, and further liquid (filtered water), and this has the claimed advantage that there will be no "contamination" of the filtered water passage, in that it will always only convey filtered water. However, the fabrication costs of providing three separate routes for the three different water supplies through the tap body, and the provision of three separate discharge passages within the common discharge spout, make this an expensive item which is not suitable for the mass market which requires the facility to obtain occasional supply of filtered water (in addition to more regular usage of hot and/or cold water), but not at premium cost.

SUMMARY OF INVENTION

The invention has therefore been developed to address this need in a way that is effective, but simpler in construction and therefore can be made available at a competitive price.

According to the invention there is provided a water tap having a tap body, separate connections on the tap body for receiving supplies of hot water, cold water and further liquid, a common discharge spout mounted on the tap body, and valves for controlling the supply of hot water, cold water and further liquid from the tap body to the discharge spout, in which:

the discharge spout is provided internally with two separate discharge passages only, which lead to a common discharge outlet of the spout;

the tap body defines a route for hot water only, under control of a hot water control valve, and which route communicates with a dedicated first one of the two separate discharge passages in the discharge spout which can therefore discharge hot water only;

the tap body also defines a separate incoming route for each of cold water and further liquid, and a common outgoing route for one or the other only of cold water and further liquid and such common outgoing route communicating with a second of the two separate discharge passages and which is dedicated to said common outgoing route; and a dual purpose valve is mounted on the tap body and is operative selectively to divert the communication of the incoming route for cold water, or further liquid, with the common outgoing route depending upon whether cold water discharge or further liquid discharge is required, and to control the flow along said common outgoing route.

Therefore, in a water tap according to the invention, two discharge passages only are provided in the discharge spout, and the first of which is dedicated to supply hot water only, whereas the second can selectively discharge cold water, or further liquid, preferably (cold) filtered water only, under the control of the dual purpose valve, and depending upon whether the valve diverts the incoming cold water route or the incoming filtered water route with the common outgoing route.

The dual purpose valve therefore can be quite simply a standard cold water control knob, button or handle, and a separate diverter valve can be sourced economically by utilising existing technology available in bath taps or similar, or incorporated into the tap body (diverters are used to divert water flow between a common discharge spout to fill the bath and a supply line leading to a shower fitting or similar).

Alternatively, the dual purpose valve may be a (single) integrated valve, in the sense that it has the dual function of (a) diverting and (b) directing flow of filtered water, or cold water via the common outgoing route and also controlling the volume of directed liquid.

The flow along the second discharge passage can be changed easily between (unfiltered) cold water supply and filtered water supply, and if there are any consumer concerns that the passage has previously conveyed unfiltered water, it is only necessary to let the filtered water flow run for a little longer to flush out the passage, before filling a glass, jug etc with filtered water.

Conveniently, the diverter valve is arranged to revert automatically to cold water routing to the common outgoing route (after operation to route filtered water), and this reversion may be after a predetermined time period e.g. for long enough to fill a glass, and under spring or other return control.

DESCRIPTION OF PREFERRED EMBODIMENTS

Figure 1:
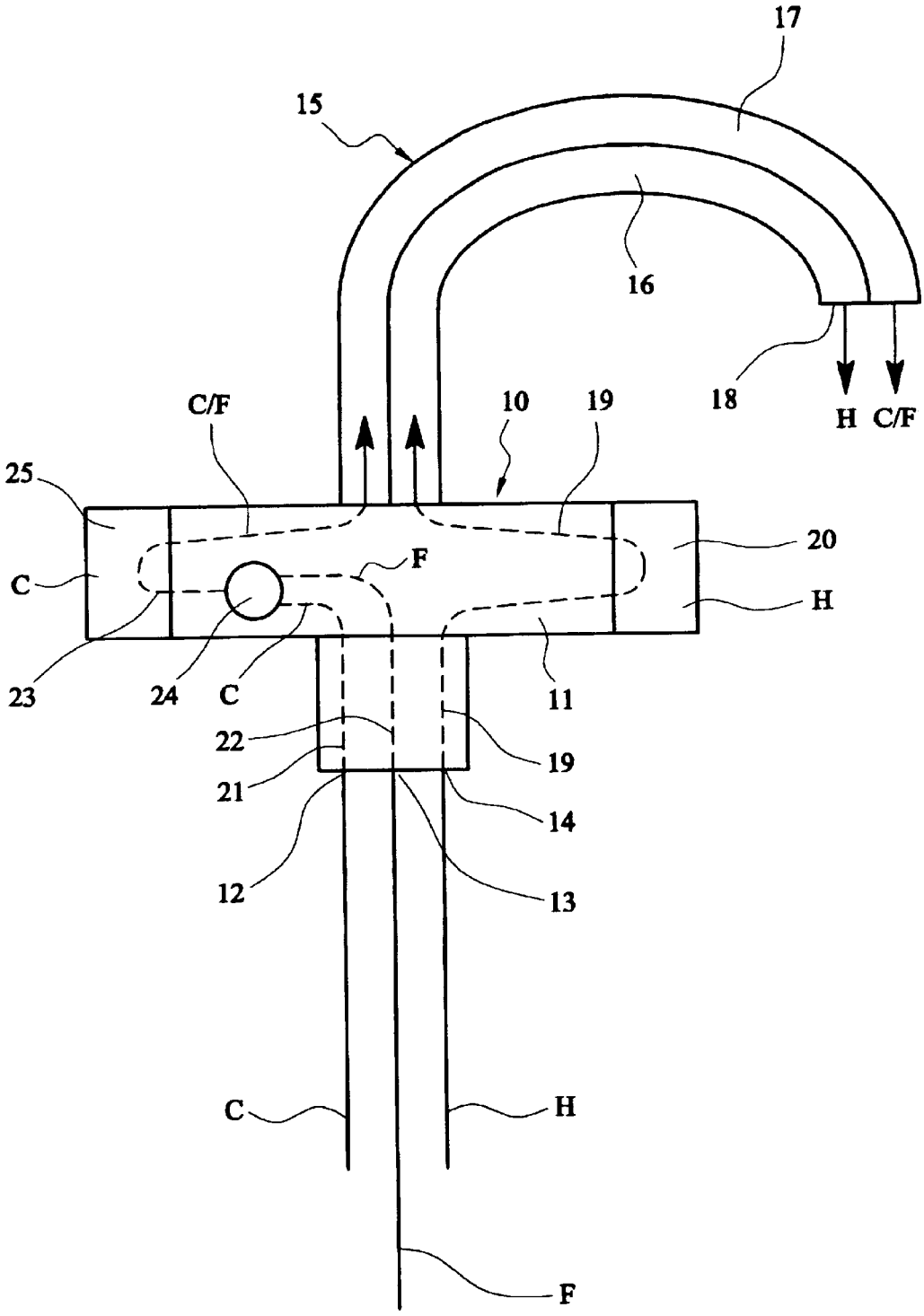
FIG. 1 is a schematic drawings of a first embodiment.

Referring to FIG. 1 of the drawings, a water tap according to the invention is designated generally by reference 10 and has a tap body 11, separate connections 12, 13, 14 on the tap body 11 for receiving, respectively, supplies of cold water C, filtered water F (further liquid) and hot water H. A common discharge spout 15 is mounted on the tap body 11, and valves are provided to control the supply of hot water H, cold water C and filtered water F from the tap body 11 to the discharge spout 15.

The discharge spout 15 is provided internally with two separate discharge passages only, namely first passage 16 which is dedicated to convey hot water H only, and second discharge passage 17 which is dedicated to supply cold water C or filtered water F. As can be seen, the passages 16 and 17 lead to a common discharge outlet 18 of the spout 15.

The tap body 11 defines a route 19 for hot water only, under control of a hot water control valve 20, and route 19 communicates with the dedicated first discharge passage 16 of the discharge spout 15, and which can therefore discharge hot water only.

The tap body 11 also defines separate incoming routes 21 and 22 for each of the cold water C and the filtered water P. The tap body 11 also defines a common outgoing route 23 for one or the other only of cold water C and filtered water F, and such common outgoing route 23 communicates with the second discharge passage 17, which is dedicated to the common outgoing route 23.

A diverter valve 24 is mounted on the tap body 11 and is operative selectively to control the communication of the incoming route 21 for cold water C, or the incoming route 22 for filtered water F, with the common outgoing route 23. According to the operation of the diverter valve, cold water C or filtered water F can be discharged via the outlet 18 of the spout 15, via dedicated second discharge passage 17.

A dual purpose water control valve 25 is provided on the tap body 11, and is operative to control the flow along the common outgoing route 23.

Therefore, in the water tap 10 shown in the drawing, two discharge passages 16, 17 only are provided in the discharge spout 15, and the first passage 16 is dedicated to supply hot water only, whereas the second passage 17 selectively discharges cold water, or filtered water only, under the control of the dual purpose water control valve 25, and depending upon whether the diverter valve 24 communicates the incoming cold water route 21 or the incoming filtered water route 22 with the common outgoing route 23.

The dual purpose water control valve 25 can be quite simply a standard cold water control knob, button or handle, and the diverter valve 24 can be sourced economically by utilising existing technology available in bath taps, or similar.

The diverter valve 24 may be arranged to revert automatically to cold water routing to the common outgoing route (after operation to route filtered water only), and this reversion may be after a predetermined time period, or under spring or other return movement control.

Alternatively, the valves 24, 25 may be integrated into a single valve assembly, having the dual function of (a) diverting and (b) routing cold water C or filtered water F via the common outgoing route, and controlling the volume of the routed liquid.

Figure 2A:
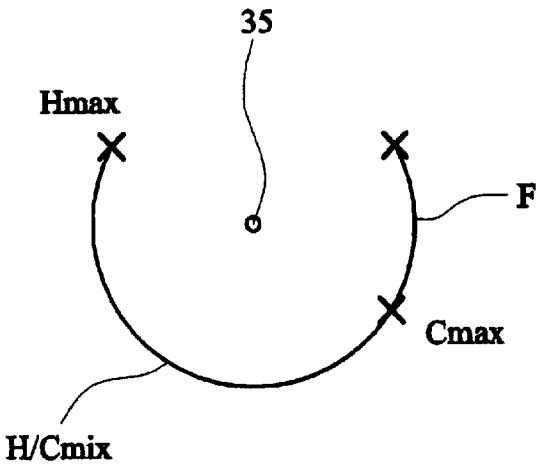
FIG. 2*a* is a schematic illustration of the range of operating movement of a single operating lever of the second embodiment of tap.
Figure 2:
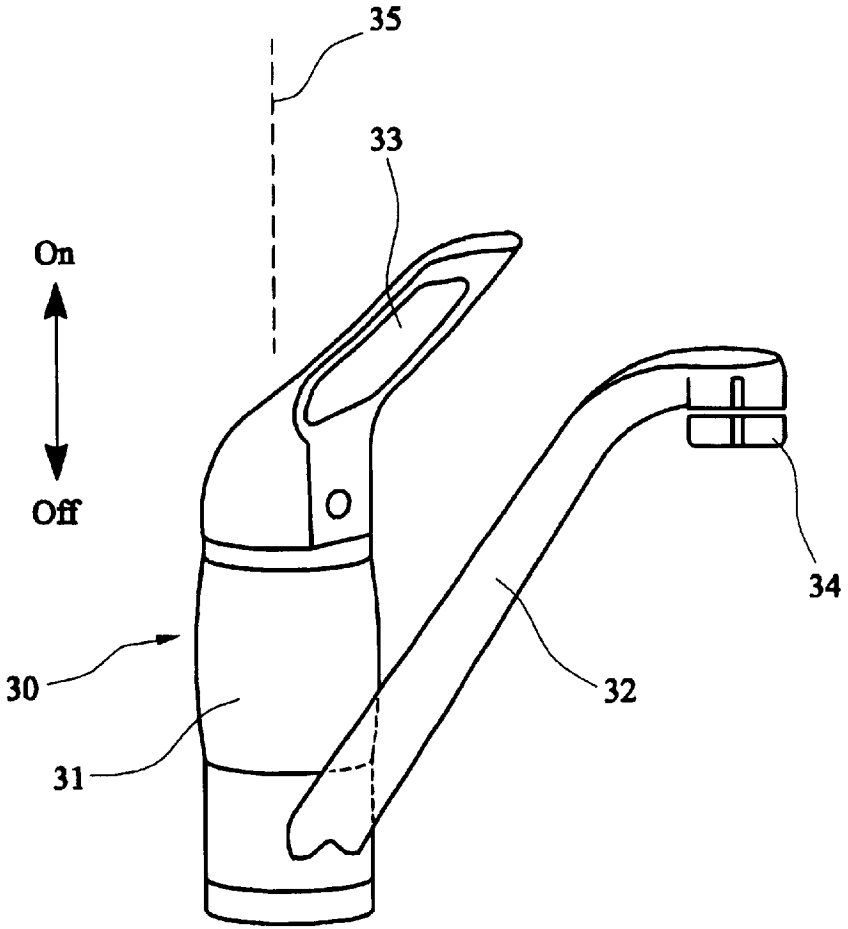
FIG. 2 is a perspective illustration of a second embodiment.

Referring now to FIG. 2 of the drawings, this shows a farther embodiment of the invention, in which the features of the schematically illustrated embodiment of FIG. 1 are incorporated into a tap assembly having a common discharge spout for all three flows of water (hot water, cold water and filtered water), and also having a single operating lever (33).

The second embodiment is designated generally by reference 30, and comprises a tap body 31 which communicates with three separate piped supplies (not shown) of hot water, cold water and filtered water, and which has a common discharge spout 32. A single operating lever 33 is provided, which can be pivoted upwardly about a horizontal axis to a maximum "on" position, and downwardly to the "off" position.

Rotation of the lever 33 about vertical axis 34 can be through three separate phases, as shown schematically in FIG. 2*a*. The rotation of the lever to the left effects operation of the internal valve assembly (not shown) to route hot water only through the tap body 31 and to be discharged via the outlet 34 of the common discharge spout 32. Rotation of the lever 33 in an anti-clockwise direction, as seen in plan view, brings it to a position in which it operates the internal valve assembly so that cold water only is routed through the tap body to be discharged via the outlet spout 34. The position of maximum hot water, and zero cold water is shown at H max, and the position of maximum cold water and zero hot water is shown at C max. Any positions between H max and C max will give variable proportion of hot/cold discharged from the outlet 34 of spout 32. Further rotation of the lever 33 beyond C max to position F brings it to a transition point, at which a "detent" is provided, and at such time the internal valve arrangement operates to divert the flow from cold water only to filtered water only, and which is routed through the discharge spout 32 and outlet 34.

This embodiment therefore provides a single lever movement tap, and may have internally a valve which has two or three purposes. The internal valve may comprise a cold/hot mixture arrangement, and progressive movement of the lever, in one direction or the other, alters the relative proportions of hot and cold water discharged from outlet 34 to suit requirements. The lever can take-up a position of hot water only, cold water only, or a mixture. Further movement through the cold range reaches the detent position, and thereafter flow is diverted to filtered water only.

Any suitable detent arrangement may be provided, including spring loaded latches etc, and preferably gives a defined "click" to indicate that the diverting point has been reached between cold water only and filtered water only.

The internal valve arrangement will take any suitable form, e.g. as disclosed above and shown schematically in FIG. 1.

What is claimed is:

1. A water tap having a tap body, separate connections on the tap body for receiving supplies of hot water H, cold water C and further liquid F, a common discharge spout mounted on the tap body, and valves for controlling the supply of hot water H, cold water C and filtered water F from the tap body to the discharge spout, in which:

the discharge spout is provided internally with two separate discharge passages only which lead to a common discharge outlet of the spout;

the tap body defines a route for hot water only, under control of hot water control valve, and which route communicates with a dedicated first one of the two separate discharge passages in the discharge spout and which can therefore discharge hot water H only;

the tap body also defines a separate incoming route for each of the cold water C and the further liquid F, and a common outgoing route for the other of cold water C and filtered water F and such common outgoing route communicating with a second of the two separate discharge passage and which is dedicated to said common outgoing route;

a dual purpose valve is mounted on the tap body and is operative selectively to divert the communication of the incoming route for cold water C, or the incoming route for further liquid F, with the common outgoing route depending upon whether cold water discharge or filtered water discharge is required, and to control the flow along said common outgoing route.

2. A water tap according to claim 1, in which the dual purpose valve comprises a cold water control knob, button or handle.

3. A water tap according to claim 1, in which the dual purpose valve is manually operable to divert flow of cold water C only, or further liquid F only, to the common outgoing route.

4. A water tap according to claim 3, in which the diverter valve is arranged to revert automatically to cold water routing to the common outgoing route, after operation to route further liquid F to the outgoing route.

5. A water tap according to claim 1, having a single lever on a tap body to control the operation of the dual purpose valve.

* * * * *

UNITED STATES PATENT AND TRADEMARK OFFICE

CERTIFICATE OF CORRECTION

PATENT NO. : 6,926,035 B2
DATED : August 9, 2005
INVENTOR(S) : Ozcan Ozagir

It is certified that error appears in the above-identified patent and that said Letters Patent is hereby corrected as shown below:

Column 3,
Line 20, delete "water P" and replace it with -- water F --.

Signed and Sealed this

Twenty-eighth Day of March, 2006

JON W. DUDAS
*Director of the United States Patent and Trademark Office*